US006210633B1

(12) United States Patent
Kratt et al.

(10) Patent No.: US 6,210,633 B1
(45) Date of Patent: Apr. 3, 2001

(54) METHOD OF MANUFACTURING ARTICLES OF COMPLEX SHAPE USING POWDER MATERIALS, AND APPARATUS FOR IMPLEMENTING THIS METHOD

(75) Inventors: Eugene Kratt; Victor Samarov; Dmitry Seliverstov, all of Moscow (RU); Roman Haykin, Leonia, NJ (US)

(73) Assignee: Laboratory of New Technologies, Leonia, NJ (US)

( * ) Notice: Subject to any disclaimer, the term of this patent is extended or adjusted under 35 U.S.C. 154(b) by 0 days.

(21) Appl. No.: 09/514,367

(22) Filed: Feb. 28, 2000

Related U.S. Application Data

(60) Provisional application No. 60/122,193, filed on Mar. 1, 1999.

(51) Int. Cl.[7] ..... B22F 3/14
(52) U.S. Cl. ..... 419/49; 264/604
(58) Field of Search ..... 419/49; 264/604

(56) References Cited

U.S. PATENT DOCUMENTS

| | | | | |
|---|---|---|---|---|
| 3,096,174 | * | 7/1963 | Helin | 75/226 |
| 3,992,200 | * | 11/1976 | Chandhok | 75/211 |
| 4,575,327 | | 3/1986 | Borchert et al. | 425/78 |
| 4,601,878 | | 7/1986 | Aslund et al. | 419/49 |
| 6,038,461 | * | 3/2000 | Sakai et al. | 505/230 |

FOREIGN PATENT DOCUMENTS

| | | |
|---|---|---|
| 29 53 250C1 | 8/1986 | (DE) . |
| 2 257 161 | 1/1993 | (GB) . |
| 7-15128 | 2/1995 | (JP) . |
| 7-17929 | 3/1995 | (JP) . |

* cited by examiner

*Primary Examiner*—Daniel J. Jenkins
(74) *Attorney, Agent, or Firm*—McDermott, Will & Emery

(57) ABSTRACT

The present invention offers a novel method of manufacturing articles of a complex shape by subjecting powder material to Hot Isostatic Pressing (HIP). The method involves manufacturing a capsule with at least one insert. The capsule is filled with outgassed powder. Thereafter, the powder in the capsule is subjected to hot isostatic pressing. The capsule is removed to produce a finished article, such as a bladed disk. The thickness of capsule walls is made variable so as to provide substantially unidirectional axial deformation of the powder during the Hot Isostatic Pressing.

10 Claims, 7 Drawing Sheets

METHOD OF MANUFACTURING ARTICLES OF COMPLEX SHAPE USING POWDER MATERIALS, AND APPARATUS FOR IMPLEMENTING THIS METHOD

The present application claims priority of U.S. provisional patent application No. 60/122,193 filed Mar. 1, 1999 and incorporated by reference in the present application.

FIELD OF THE INVENTION

The present invention relates to powder metallurgy, and more particularly to forming articles or parts of complex shape by subjecting metal powder material to Hot Isostatic Pressing (HIP).

DESCRIPTION OF BACKGROUND ART

There exist different methods of manufacturing shaped parts from powders using Hot Isostatic Pressing technique. The main feature of these techniques is that free shaping (volumetric shrinkage) of a piece is performed by isostatic gas pressure at high temperatures and therefore there is no any rigid tool conventional for traditional processes of hot metal forming. All these methods use metallic cans or capsules as a plastically deformed tool to give initial shape to powder and to transfer external HIP pressure on it.

Usually capsules with constant wall thickness of 2–3 mm are used for HIP. Along with advantages of this method such as the possibility of manufacturing large-size parts with isotropic structure of material and 100% density it has some serious disadvantages while complex shape parts are considered:

- during HIP in capsules with constant wall thickness substantial distortions caused by radial shrinkage occur and lead to poor dimensional precision of the powder parts and low material yield;
- irregularity of powder tap density in different sections and channels of the capsule and local deviations in capsule and powder material properties lead to difficulties in controlling the shrinkage and final shape of complex shape parts such as turbine and compressor disks with blades and as a result-cause shape distortions after HIP;
- if powders with tap density less than 65–70% are used for HIP, it leads to strong distortions during shrinkage and makes it impossible to manufacture shaped parts using the above method;

During conventional HIP of powders with 65–70% initial density in capsules with constant wall thickness the values of radial and axial shrinkage constitute 12–13% and 14–16% correspondingly.

For large size parts such as turbine disks of 500–600 mm (20–24") diameter these values of radial shrinkage can reach 60–70 mm (2.5–3"). Such large radial deformations inevitably lead to geometrical distortions of parts during HIP. Therefore it is necessary to reduce the absolute values of radial deformations during HIP. Besides, while manufacturing parts by conventional HIP method in capsules with constant wall thickness only powders with high tap density (more than 55–60%) can be used, otherwise initial internal pressure inside the capsule is so low that the capsule looses its shape under high external pressure during radial shrinkage. This does not enable to manufacture by HIP parts with desired geometry from many perspective powder materials such as powders of refractory alloys with initial density less than 30%. In order to have active control of the shrinkage process and of the final geometry the following manufacturing method based on shrinkage regulation by a new design of capsules with variable wall thickness is proposed.

SUMMARY OF THE INVENTION

The present invention offers a novel method of manufacturing articles of a complex shape by subjecting powder material to Hot Isostatic Pressing (HIP). The method involves manufacturing a capsule with at least one insert. The capsule is filled with outgassed powder. Thereafter, the powder in the capsule is subjected to hot isostalic pressing. The capsule is removed to produce a finished article, such as a bladed disk.

In accordance with the present invention, the thickness of capsule walls is made variable so as to provide substantially unidirectional axial deformation of the powder during the hot isostatic pressing.

In a preferred embodiment of the present invention, the capsule may have upper and lower butt elements and lateral cylindrical elements with the thickness of butt elements exceeding the thickness of lateral cylindrical elements. Masses or volumes of metal of upper and lower butt elements may be made equal.

Dimensions of the upper and lower butt elements may be determined as a function of initial tap density of the powder, and target dimensions of the article. For example, the thickness of the lower butt element may be less than that of the upper butt element provided they have equal masses or volumes.

Preferably, the capsule and inserts are provided with additional cavities to be filled with powder. These cavities provide suppressing capsule distortion during HIP. Lateral surfaces of the insert may be made concave.

The object of the present invention is to develop the method of manufacturing complex "net" and "near net" shape parts (including those with non-machined surfaces) from powder materials (including those with low tap and loose density) by HIP as well as to develop the design of the capsules in order to suppress the above described distortions.

The object is attained according to the invention by making capsules with variable controlled wall thickness providing substantially uniformal axial deformation during HIP. For predicting dimensions of a HIPed part there exist various computer based models of the process which use as an input theological properties of densified powder and capsule materials at elevated temperatures. These data originate from some model experiments.

However these model experiments as well as their results and process model based on them cannot account all the peculiarities of deformation and consolidation during HIP and therefore the accuracy of dimensional prediction based on existing models is about 1–2% of corresponding linear displacements during HIP.

Therefore, it is necessary to minimize radial shrinkage during HIP and it can be performed by changing the construction of the said capsule by changing the ratio of thickness between different capsule elements.

For example, if the thickness of the upper and lower butt elements (responsible for radial stiffness) is increased and that of cylindrical elements (responsible for axial shrinkage)—reduced it is possible to re-distribute considerably the values of radial and axial deformations during HIP.

If the ratio of thickness for the butt and cylindrical elements increases to 5:1 the corresponding values of axial and radial shrinkage for the same capsule described above change from 14–16% to 35–40% and from 12–13% to 3–4%. It means that the value of the radial shrinkage becomes 3–4 times less than while using conventional capsules, and the capsule with powder is subjected to substantially unidirectional deformation. It leads to much better dimensional precision of HIPed parts (their accuracy also increases 3–4 times), reduces 5–10 times distortions caused by radial deformations and what is very important—provides higher reproducibility of dimensions in large manufacturing lots.

For favorable distribution of shrinkage the ratio of plastic stiffness of butt and cylindrical elements (which is proportional to the volume of corresponding capsule elements multiplied by the yield stress value of the capsule material) should be kept in the range of 5–10.

However the change of the capsule wall thickness can lead to the changes of volumes (masses) of upper and lower capsule butt elements which determine their radial stiffness. As a result of this non-equilibrity of capsule volumes and their different stiffness capsule can warp or twist during shrinkage under HIP. Therefore it becomes necessary to keep the balance of the plastic stiffness between the upper and lower parts of the capsule. If this principle is not accounted large distortions and bending of the capsule during HIP will occur.

Besides during manufacturing by HIP of bladed disks with powder blades formed during HIP there usually happen some distortions of the edges of blades due to the non-uniform plastic stiffness of different capsule elements. When a solid insert (for example a ring with slots for shaping blades) is placed inside a capsule it can also lead to additional local distortions during shrinkage as the local stiffness of the construction can change. Also "barrel effect" on the walls of the blade channel is observed due to non-uniform deformation.

In order to provide straight blade edges after HIP the local stiffness of inserts which form the blades should be decreased. To provide controlled deformation and stable shape of the blades after HIP, additional cavities to be filled with powder are made in the capsule elements or in the insert. These cavities lead to local reduction of the axial stiffness and reduce shape distortions. Also local distortions of the blade channel are reduced by making the lateral surfaces of the insert concave.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE INVENTION

Figure 1:
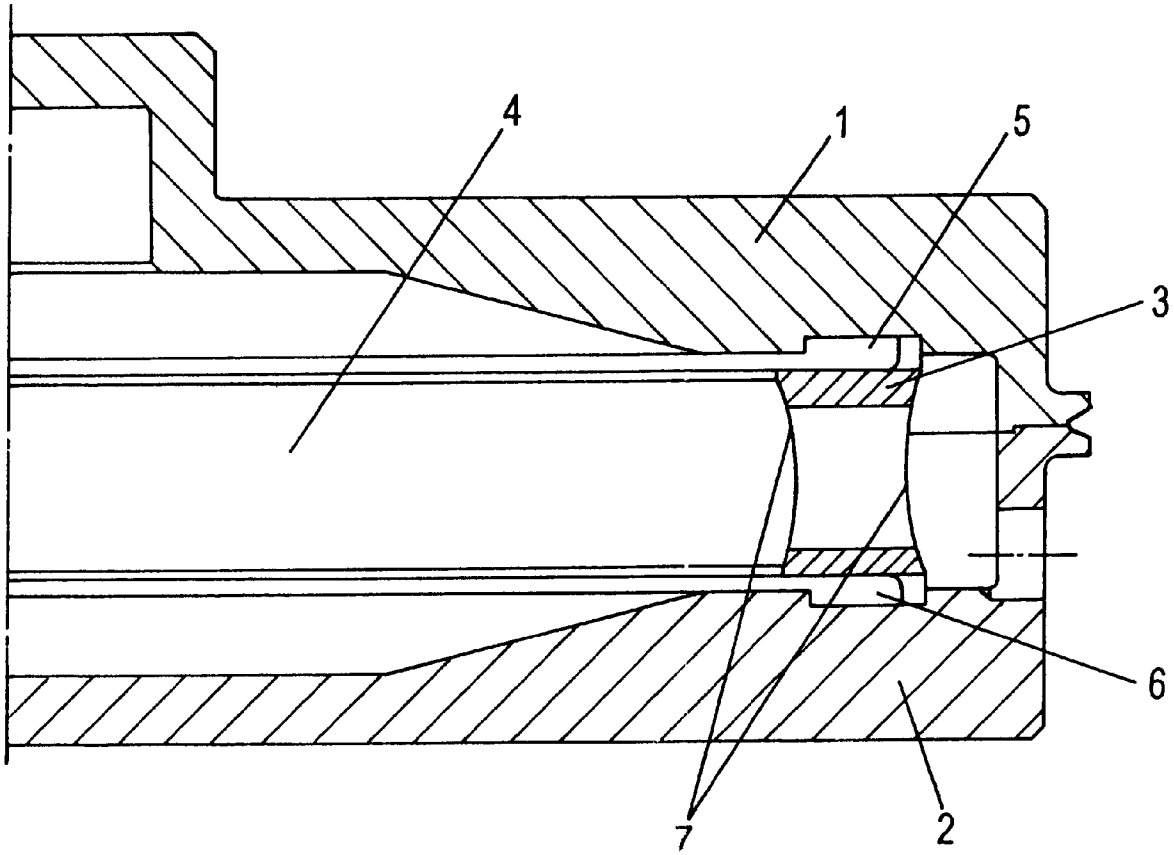
FIG. 1 is an axial section view of a capsule.

FIG. 1 is an axial section view of the capsule consisting of an upper and lower elements 1 and 2 and an insert 3 with slots for powder blades located inside it. The volumes (masses) of material in the upper and lower elements 1 and 2 are equal to each other. Besides the thickness of the upper and lower butt elements 1 and 2 is higher than the wall thickness of the cylindrical part of the above elements.

Increase of radial stiffness of the capsule enables to minimize its radial shrinkage during HIP, to improve dimensional precision of HIPed parts and to avoid distortions like warping and torsion.

Capsule has the main internal volume 4 to be filled with powder for shaping the part. Besides there are additional cavities 5 and 6 made in the capsule elements 1 and 2 and in the insert 3 also to be filled with powder for prevention of local distortions of blades during HIP.

In order to reduce local distortion of the insert 3, its lateral surfaces 7 are made concave.

Figure 2:
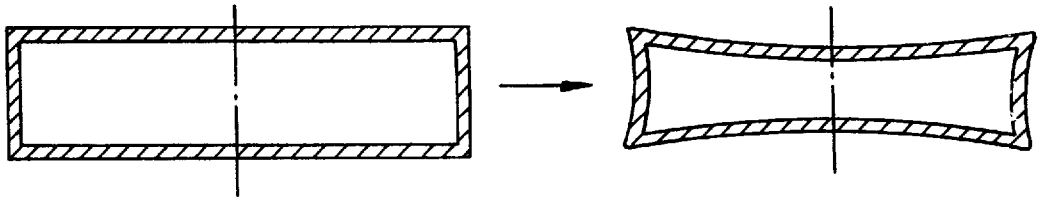
FIG. 2 is a view of distortions which occur after HIP when a capsule has constant (uniform) wall thickness.
Figure 3:
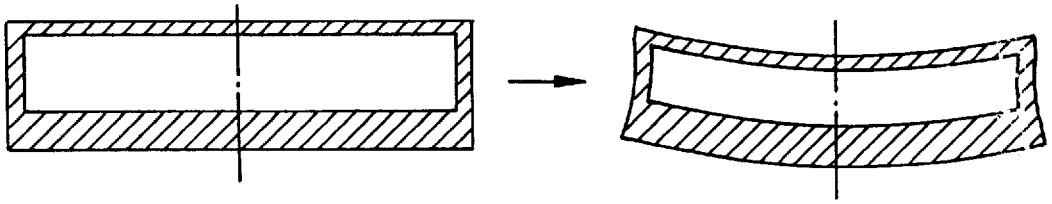
FIG. 3 is a view of distortions which occur after HIP when a capsule has different volumes (masses) of the upper and lower butt elements.
Figure 4:
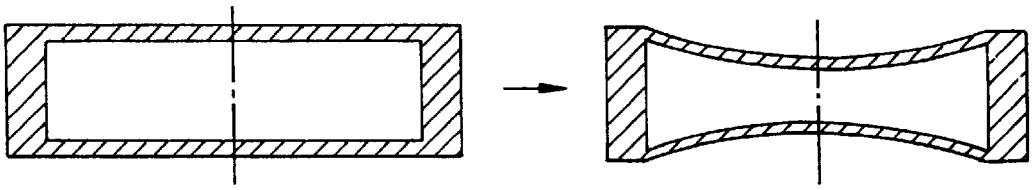
FIG. 4 is a view of distortions which occur after HIP for a capsule with the wall thickness of cylindrical element higher than that of the upper and lower butt elements.
Figure 5:
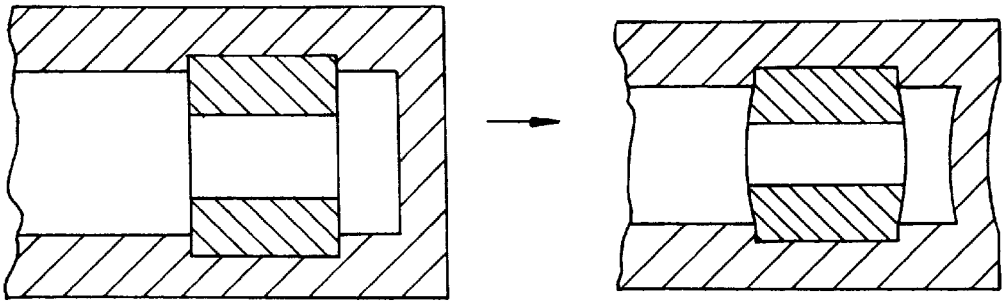
FIG. 5 is a view of local distortions of powder blades after HIP when the capsule does not have additional cavities for powder and the insert does not have concave lateral surfaces.

FIG. 2 is a view of distortions which occur after HIP when a capsule has constant (uniform) wall thickness. FIG. 3 is a view of distortions which occur after HIP when a capsule has different volumes (masses) of the upper and lower butt elements. FIG. 4 is a view of distortions which occur after HIP for a capsule with the wall thickness of cylindrical element higher than that of the upper and lower butt elements. FIG. 5 is a view of local distortions of powder blades after HIP when the capsule does not have additional cavities for powder and the insert does not have concave lateral surfaces.

Figure 6:
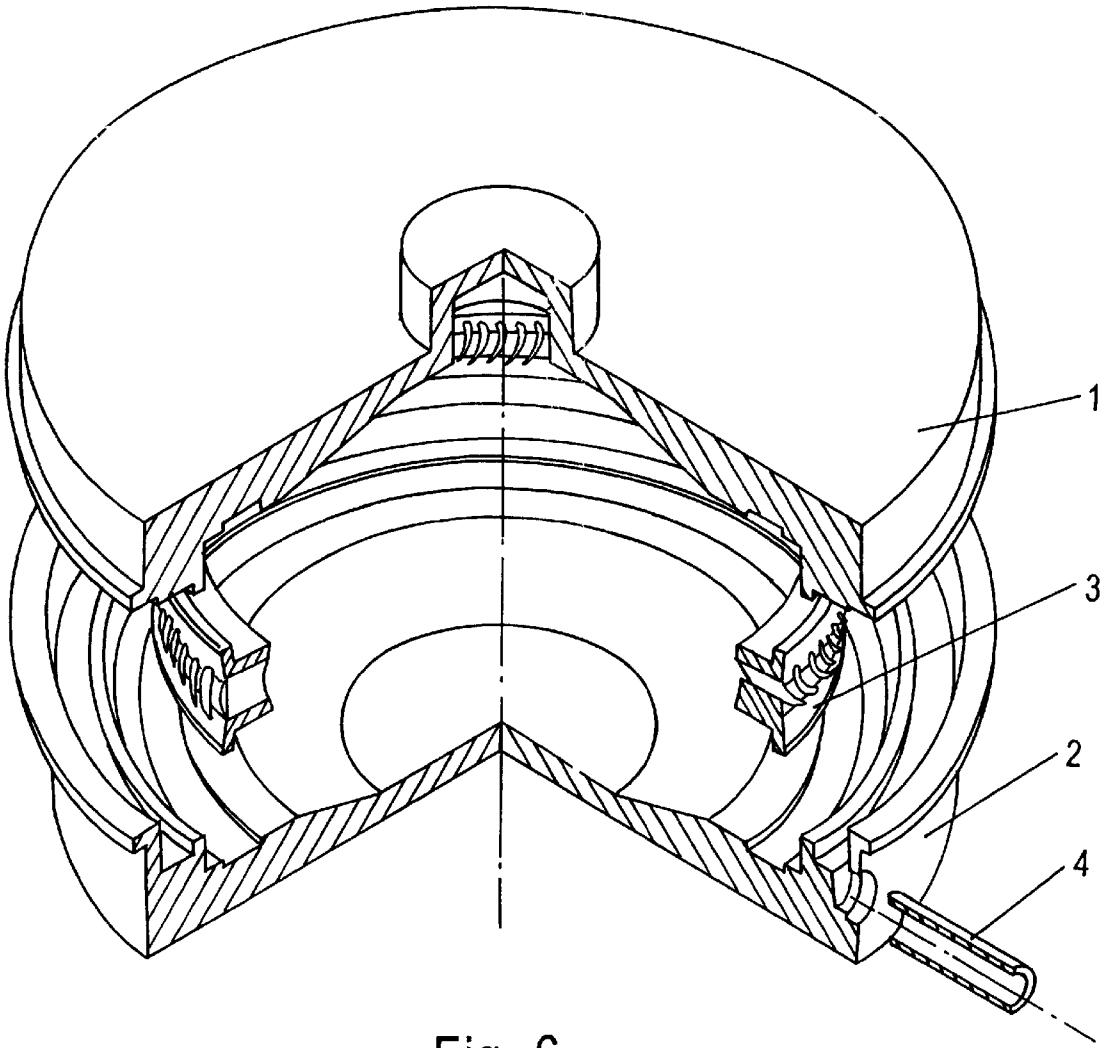
FIG. 6 illustrates a tooling design.

In order to manufacture a disk with blades (blisk) from powder Fe—Ni-base superalloy JBK-75 by Hot Isostatic Pressing a tooling design presented on the FIG. 6 was developed.

The tooling consists of:

capsule upper and lower butt elements 1, 2 to give shape to the disk;

insert to shape the blades 3;

filling stem for powder 4;

The insert 3 was made from low carbon steel by turning and EDM providing the necessary geometry of the slots to be filled with powder for shaping powder blades during HIP. The lateral surfaces of the insert 3 were made concave.

Figure 7:
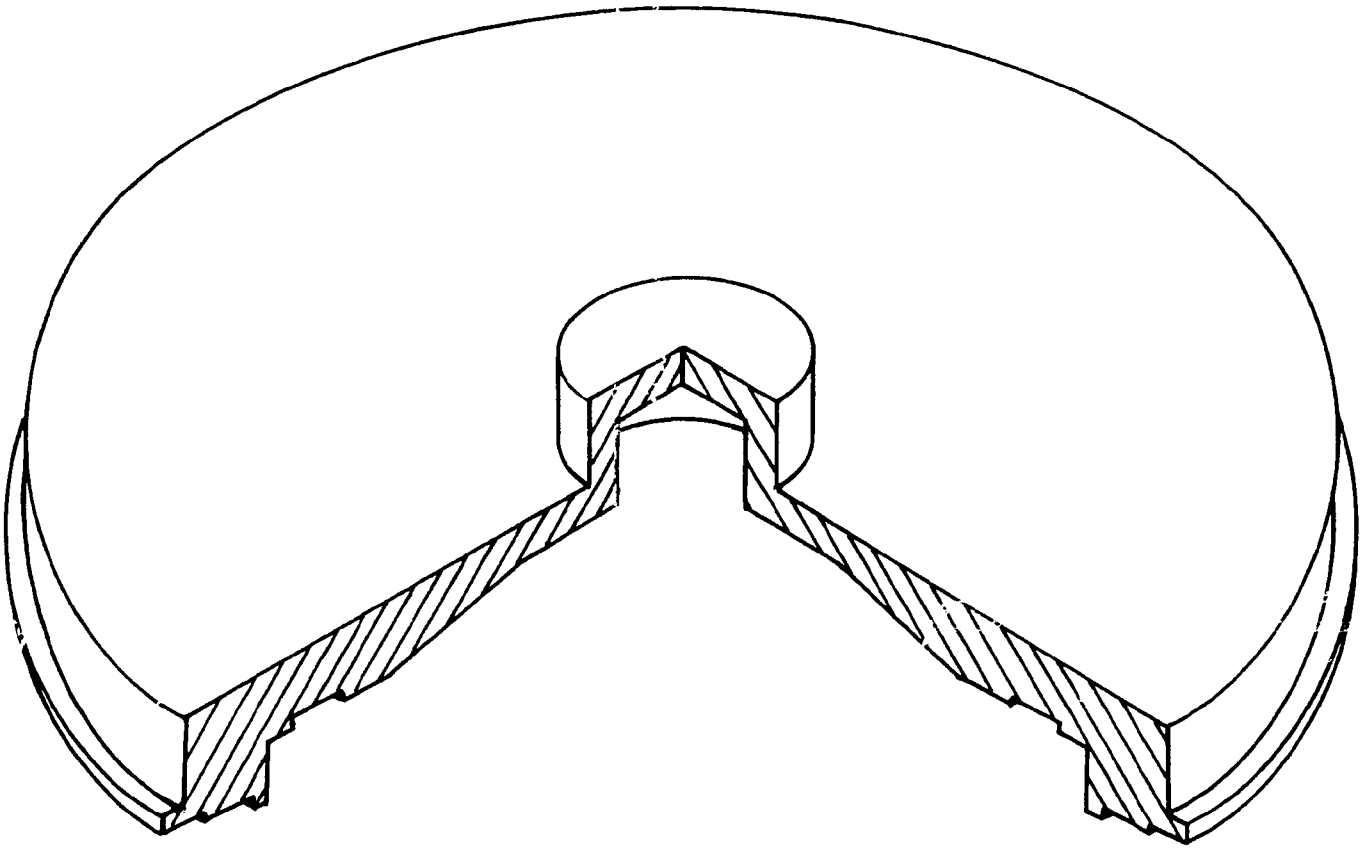
FIGS. 7 and 8 respectively illustrate upper and lower butt elements.
Figure 8:
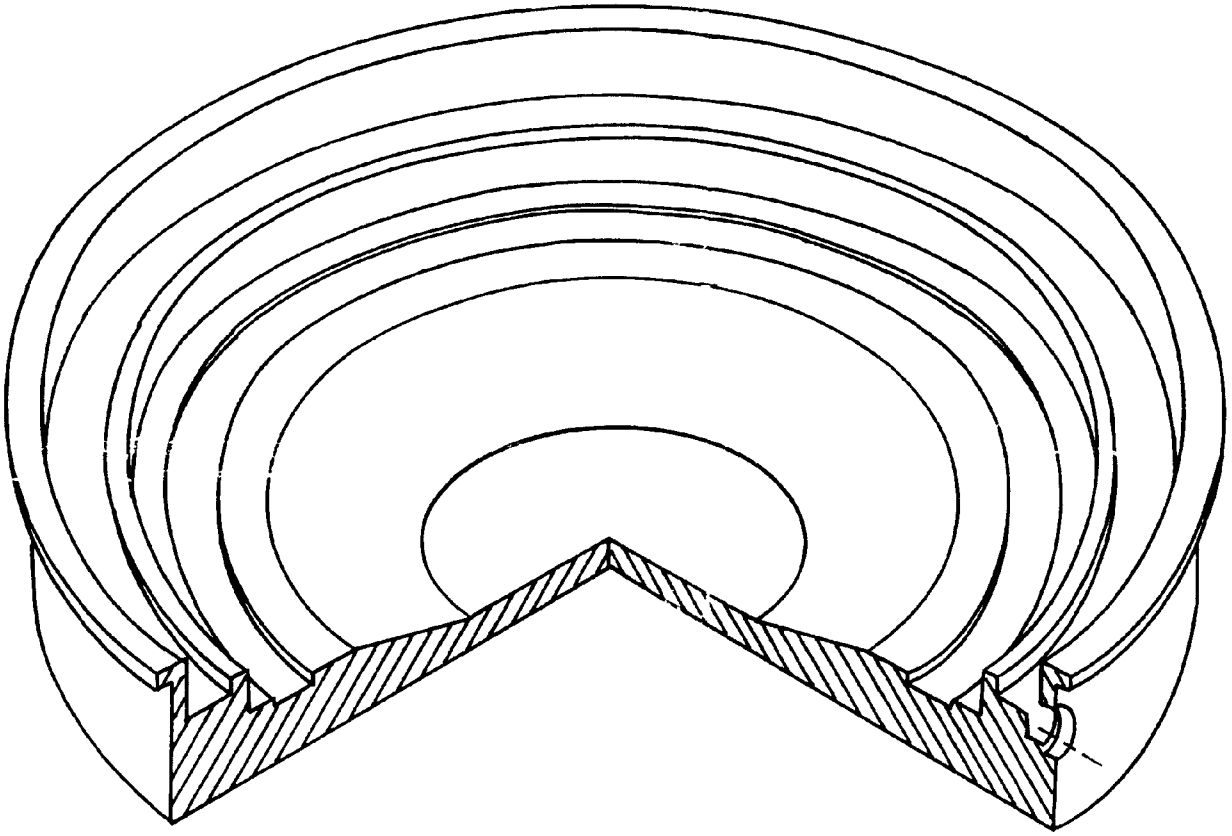

The upper and lower butt elements shown in FIG. 7 and 8 were made from low carbon steel and shaped by turning of other metal forming technique to give the necessary shape to powder prior and during HIP and had variable wall thickness (from 16 to 30 mm) but equal volumes (masses) of material.

The cylindrical wall of the lower butt element has the thickness, which is by 5 mm less than that of the upper and lower butt elements. The dimensions of the internal shape of the capsule to be filled with powder were determined basing on the mathematical model of the process accounting joint plastic deformation of compressible material (powder) and noncompressible material (capsule).

For manufacturing such complex shaped parts as bladed disks by HIP mathematical modeling of the shrinkage during HIP is necessary and it includes the following tasks:

1. Computer modeling of deformation field during HIP;

2. Identification of the model, creation of data base;
3. Solution of the inverse task, i.e. obtaining the dimensions of a part according to results of modeling;
4. Development of effective capsule designs.

These tasks are closely connected, so only a complex solution enables successful design of capsules for HIP.

Shrinkage of powder material during HIP has the following deformation mechanisms: plasticity, creep, diffusion. However an adequate description of shrinkage for typical HIP cycles may be obtained on the basis of plasticity theory applied to powder materials. It is connected with the fact that the main distortion of the capsule with powder take place on the first stage of densification, during plastic deformation of capsule and powder materials.

So the task of modeling is reduced to solving of a system of equations of plasticity theory including: equilibrium equations, cinematic equations for deformation rate components, discontinuity equation, determination equations, thermal conductivity equations and plasticity criterion.

A finite element numerical computation method was used for modeling. The input data were: the target geometry of the part, initial tap density of powder and Theological properties of powder and capsule materials during HIP cycle.

Numerical models based on continuous media mechanics can predict the final shape of a capsule with powder after HIP. In practice, however, a reverse task—calculation of capsule dimensions is necessary. A special iterative procedure was used and as a result dimensions of the capsule elements 1, 2 were specified as a function of initial tap density.

Before assembling capsule elements and insert were carefully cleaned in fat removing solution and annealed in vacuum.

Figure 9:
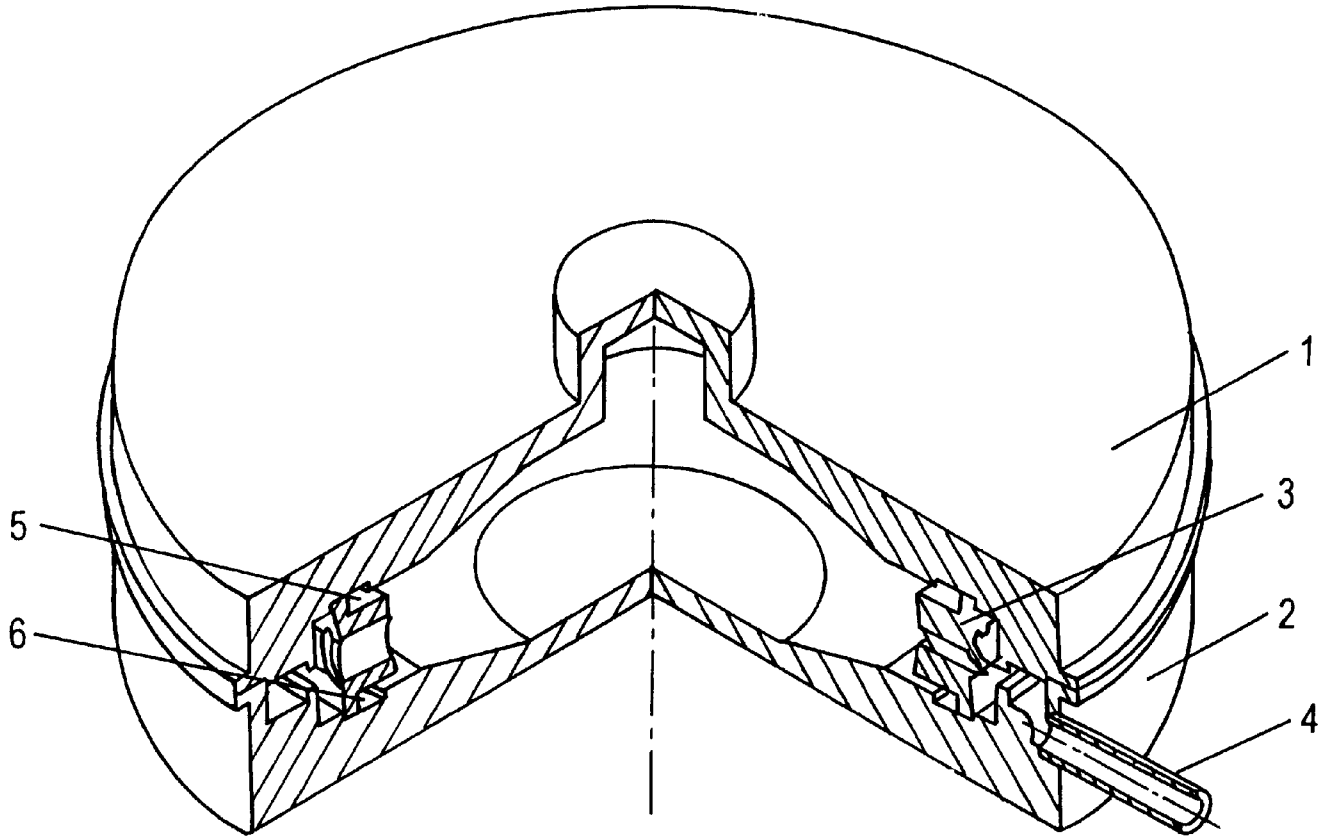
FIG. 9 illustrates a capsule assembly.

The capsule assembly is presented on the FIG. 9. Both upper and lower capsule butt elements and the insert had additional cavities 5, 6 to be filled with powder aimed at reduction of local stiffness in the area of powder blades. The insert 3 was fixed in the slots of the upper and lower capsule elements 1, 2. This design of the capsule provided stable substantially unidirectional axial deformation of powder during HIP and reproducible shape of the part such as a disk with blades.

After assembling, capsule elements were joined by argon welding and filled with powder under vacuum.

The Fe—Ni base powder with the particle size of −150 mesh was produced by argon atomizing technique. Tap density after filling and vibration with the frequency of 50 Hz was at the level of 71%. After reaching this density by controlling the weight of powder in the capsule it was adjusted to a vacuum pump, outgassed and subjected to additional thermal outgassing at 400° C. during 4 hours. After that the filling stem was sealed by welding. Capsule with powder was subjected to HIP at the temperature of 1130° C. at the pressure of 150 MPa during 1 hour.

After HIP and heat treatment, the capsule and insert were removed at first by turning and finally by pickling in 30% nitric acid. As a result, a bladed disk with "net shape" configuration of the blades and aerodynamic channel was obtained. The geometry of the blades is in accordance with the dimensional specification. Tolerance provided is better than 0.5 mm (0.0020"). The material of the bladed disk possessed 100% density, appropriate microstructure and material properties.

In this disclosure, there are shown and described only the preferred embodiments of the invention, but it is to be understood that the invention is capable of changes and modifications within the scope of the inventive concept as expressed herein.

What is claimed is:

1. A method of manufacturing articles of a complex shape by subjecting powder material to Hot Isostatic Pressing (HIP), the method including the steps of:

manufacturing a capsule with at least one insert, filling the capsule with outgassed powder, subjecting the powder in the capsule to hot isostatic pressing, and removing the capsule to produce a finished article, wherein thickness of capsule walls is made variable so as to provide substantially unidirectional axial deformation of the powder during the hot isostatic pressing.

2. The method of claim 1 wherein the capsule has upper and lower butt elements and lateral cylindrical elements with the thickness of butt elements exceeding the thickness of lateral cylindrical elements.

3. The method of claim 2, wherein volumes of metal of upper and lower butt elements are made equal.

4. The method of claim 2, wherein masses of the upper and lower butt elements are made equal.

5. The method of claim 4, wherein thickness of the lower butt element is less than that of the upper butt element.

6. The method of claim 2, wherein dimensions of the upper and lower butt elements are determined as a function of initial tap density of the powder.

7. The method of claim 6, wherein dimensions of the upper and lower butt elements are determined as a function of target dimensions of the article.

8. The method of claim 1, wherein the capsule and inserts are manufactured with additional cavities to be filled with powder for suppressing capsule distortion during HIP.

9. The method of claim 1, wherein lateral surfaces of the insert are made concave.

10. The method of claim 1, wherein the finished article is an integral bladed disk.

* * * * *